US005512355A

United States Patent [19]

Fuson

[11] Patent Number: 5,512,355

[45] Date of Patent: Apr. 30, 1996

[54] ANTI-STATIC WOVEN COATED FABRIC AND FLEXIBLE BULK CONTAINER

[75] Inventor: William R. Fuson, Wilmington, Del.

[73] Assignee: E. I. du Pont de Nemours and Company, Wilmington, Del.

[21] Appl. No.: 253,035

[22] Filed: Jun. 2, 1994

[51] Int. Cl.[6] ..... B32B 7/00

[52] U.S. Cl. ..... 428/244; 428/245; 428/255; 428/257; 428/258; 428/265; 428/297; 383/24; 383/117

[58] Field of Search ..... 428/373, 244, 428/245, 255, 257, 258, 265, 297; 383/24, 117

[56] References Cited

U.S. PATENT DOCUMENTS 5,071,699 12/1991 Pappas et al. ..... 428/265

5,202,185 4/1993 Samuelson ..... 428/373

*Primary Examiner*—Patrick J. Ryan

*Assistant Examiner*—Richard Weisberger

[57] ABSTRACT

Anti-static fabric and bulk containers made of polypropylene fibers and interlaced carrier yarn. The carrier yarn is of nylon or polyester fibers and sheath-core fibers in which the sheath is nylon or polyester, and the core selected from the group consisting of polyolefin, nylon and polyester and contains conductive carbon black or graphite. The carrier yarns are spaced apart in the fabric, and serve to dissipate static electric charges.

9 Claims, No Drawings

ANTI-STATIC WOVEN COATED FABRIC AND FLEXIBLE BULK CONTAINER

FIELD OF THE INVENTION

This invention relates to woven coated fabrics and flexible bulk containers having anti-static properties. The major component in the fabrics and containers of the invention is polypropylene, the minor component in the fabrics and containers of this invention is a carrier yarn of non-conductive nylon or polyester fibers and sheath-core filaments in which the core is a conductive polymer selected from polyolefin, nylon and polyester and filled with conductive carbon black or graphite and the sheath is nylon or polyester.

BACKGROUND OF THE INVENTION

Flexible bulk containers made from woven polypropylene, having a coating of thermoplastic polypropylene containing a polyol ester of a monocarboxylic acid anti-static agent are disclosed in Pappas U.S. Pat. No. 5,071,699. Optionally the bulk containers of Pappas may have conductive fibers interwoven with the woven polypropylene. The conductive fibers may be metal such as stainless steel or copper, or a carbon fiber. Preferably the conductive fiber is itself a plastic material such as nylon or polyester monofilament which has been coated with a highly conductive metal such as silver or copper.

Flexible bulk containers containing electrically conductive polyolefin threads are also disclosed in U.S. Pat. No. 5,092,683 to Wurr. In this patent the electrically conductive polyolefin threads contain dispersed carbon black and/or graphite and are woven into both the warp and weft of the fabric. Sheath-core filaments having conductive cores are known and are disclosed in U.S. Pat. No. 5,202,185 to Samuelson and U.S. Pat. No. 3,803,453 to Hull. The cross-section of the core of the Samuelson filaments is multilobal, while cross-section of the core of the Hull filaments is circular. In Samuelson the sheath is either nylon or polyester and the core is polyethylene containing conductive carbon black.

It is an object of the present invention to provide a fabric and a container having anti-static properties in which the filaments are sheath-core filaments in which the core is conductive and the sheath is nylon or polyester, and the filaments having the conductive core are combine in the fabric as part of a nylon or polyester carrier yarn that is woven into the fabric at spaced intervals. The nylon or polyester of the sheath protects the conductive core, and the non-sheath-core nylon or polyester filaments in the carrier yarn have many of the same physical characteristics as the sheath-core fibers.

SUMMARY OF THE INVENTION

The present invention is a bulk container comprising flexible walls of (a) interwoven yarns of axially oriented, crystalline polypropylene and an interlaced carrier yarn selected from the group consisting of polyester and nylon yarn said carrier yarn containing sheath-core filaments having a conductive core in which the core is selected from the group consisting of polyolefin, polyester and nylon and containing electrically conductive carbon black or graphite and the sheath is nylon or polyester and (b) a coating of a thermoplastic polymer adhered to the inner surface of the flexible walls, said flexible walls being capable of dissipating an electrical charge.

The present invention is also a fabric of (a) interwoven yarns of axially oriented, crystalline polypropylene and an interlaced carrier yarn selected from the group consisting of polyester and nylon yarn said carrier yarn containing sheath-core filaments having a conductive core in which the core is a selected from the group consisting of polyolefin, polyester and nylon and containing electrically conductive carbon black or graphite and the sheath is nylon or polyester and (b) a coating of a thermoplastic polymer adhered to one surface of the interwoven yarns, said fabric being capable of dissipating an electrical charge.

Preferably the core of the sheath-core conductive filament is polyethylene containing 0.3 to 35% by weight conductive carbon black. Most preferably the core of the sheath-core bicomponent filaments has from three to six lobes and a modification ratio of at least 2, with each lobe having an L/D ratio of 1 to 20, where L is the length of a line drawn from the center point of the line between low points of adjacent valleys on either side of the lobe to the farthest point on said lobe, and D is the greatest width of the lobe as measured perpendicular to L.

Preferably the interlaced carrier yarn has a denier of between 800 and 3000, and the electrically conductive filaments comprise between 5 and 25% by weight of the carrier yarn. Usually the denier of the filaments in the carrier yarn is in the range of 1 to 20 denier.

Preferably the carrier yarn comprises between 1% and 18% by weight of the fabric.

Preferably the thermoplastic coating is polypropylene and the coating comprises between 5 and 20% by weight of the fabric. The thermoplastic coating on the fabric is necessary to achieve a container that will be suitable to hold finely divided material, such as for example pigments. The fabric and containers of the fabric of this invention are particularly useful in handling of titanium dioxide pigments, which are often unloaded in areas such as paint producing plants where flammable fumes are a hazard that might be ignited electric spark discharge.

Preferably the carrier yarn is distributed at evenly spaced intervals in the fabric at spacings of between ¼ and 2 inches.

Preferably the polypropylene yarns of axially oriented polypropylene are composed of a tight weave of axially oriented polypropylene flat tape.

In the fabric and container of the invention the carrier yarn runs in either the warp direction or the weft direction, but usually not both.

DETAILED DESCRIPTION

The fabric and container of the invention are improvements over the fabric and container shown in Pappas U.S. Pat. No. 5,071,699, which is incorporated herein by reference, where the improvement is in the use of an interlaced carrier yarn of polyester or nylon containing sheath-core filaments where the sheath is nylon or polyester and the core is conductive polymer selected from the group consisting of polyolefin, nylon and polyester. The fabric and container of the invention has adequate dissipative performance without the inclusion of an antistatic agent such as polyol ester of a monocarboxylic acid in the thermoplastic coating; however, such agents may be included if desired.

The interlaced carrier yarn, can be prepared by techniques well known in the art, for example by the technique disclosed in Bunting et al U.S. Pat. No. 2,985,995 issued May 1961. In interlaced carrier yarns the individual filaments are kinked, bent and entangled with other filaments, but are not bonded to the other filaments. The interlaced carrier yarns will usually be made from continuous filaments, but it is possible to obtain satisfactory yarns containing some staple fibers.

The individual filaments of the carrier yarn are bent and loosely interlocked. The interlaced carrier yarn can thus be elongated by application of tension without significant stretching the individual filaments—the filaments merely straighten to some extent, and when the tension is removed the filaments tend to return to their bent condition.

The use of a carrier yarn makes it easier to weave sheath-core fibers with the large denier polypropylene yarns which comprise the bulk of the fabric and container of the invention. Furthermore, because the non-sheath-core filaments in the carrier yarn have most of the same physical properties as the sheath-core fibers, the stress and strain caused by the somewhat different physical properties of the polypropylene yarns and the carrier yarns are distributed over the entire carrier yarn rather than borne by only the sheath-core filaments. The polypropylene yarns of the fabric and containers of the invention are the major load bearing components. The carrier yarns are interlaced and the individual filaments (both sheath ore and non-sheath-core) will straighten and flex as load is applied to or removed from the fabric or container.

The sheath-core filaments are preferably of the type disclosed in U.S. Pat. No. 5,202,185 to Samuelson, and comprise a continuous nonconductive sheath of synthetic thermoplastic fiber forming polymer selected from the group consisting of polyester and polyamide (nylon) surrounding an electrically conductive polymeric core, constituting from 0.3% to 35% of the filament crosssection, said polymeric core comprising 10 to 35% of electrically conductive carbon black or graphite dispersed in polyethylene the cross-section of said core having from three to six lobes and a modification ratio of at least 2, with each lobe having an L/D ratio of from 1 to 20 and where L is the length of a line drawn from the center point of the line between low points of adjacent valleys on either side of the lobe to the farthest point on said lobe, and D is the greatest with of the lobe as measure perpendicular to L. The Samuelson patent is incorporated herein by reference.

The polypropylene yarns that make up the majority of the fabric and container of the present invention are preferably tight weave axially oriented polypropylene flat tape material having a preferred thickness of about 0.5 to 2 mils and a preferred width of about 50 to 250 mils.

The thermoplastic coating may be composed of any thermoplastic polymer composition which is sufficiently non-brittle that the flexible characteristics of the woven fabric are not greatly diminished and which adhere to the polypropylene yarn material. Preferred thermoplastics from the coating include polypropylene, polyethylene polyisobutylene, copolymers of ethylene and higher olefins such as propylene or butene. The preferred coating is polypropylene.

The thermoplastic coating may be applied to one or both surfaces of the woven fabric by techniques known in the art such as extrusion coating, dip coating, and spray coating. Generally the coating thickness will be in the range of about 0.5 to 3.0 mils, but preferably not more than about 1.5 mils.

EXAMPLE

A carrier yarn was made by interlacing 3 ends of sheath-core nylon filament 70 denier yarn with 25 ends of 40 denier 13 filament nylon yarn. The sheath-core yarn had 12 filaments per end and each filament was a bicomponent sheath-core filament having a core of polyethylene containing electrically conductive carbon black. The core was a trilobal core as described in Samuelson patent 5,202,185. The core of the sheath-core yarn was about 15% of the cross-section of the yarn, and contained 32% by weight conductive carbon black.

A fabric was woven of axially oriented crystalline polypropylene yarn and the carrier yarn. The carrier yarn was used only in the warp direction, and the carrier yarns were spaced apart in the fabric at nominally 1⅛ inch intervals. In the warp direction, the polypropylene yarn had a denier of 1300, but in the warp direction, every other yarn was two ply, (one on top of the other). The polypropylene yarn used in the weft direction had a denier of 2,550. There were 13 yarns per inch in the warp direction and 11 yarns per inch in the weft direction. The polypropylene yarns were made by extruding a flat tape, and then slitting the extrudate and drawing the slit strips.

The carrier yarn was about 1.9% by weight of the fabric, and the sheath-core fibers were about 0.4% by weight of the fabric.

The fabric was then coated on one side by extrusion of a polypropylene thermoplastic coating. The coating contained no anti-static agent. The coating thickness was about one mil.

The coated fabric had nominal a weight of a 6.5 ounces per square yard.

The coated fabric was tested for its electrostatic properties as follows: A 3-inch by 5-inch specimen, was placed on a grounded metal plate and charged by negative corona from a Simco single-point ionizer connected to a Simco CH25 d.c. power supply with a voltage of 14 kV, the ionizer was moved back and forth over the fabric about six times. The specimens were charged and tested with the conductive fibers perpendicular to the earth. The charged specimen was then lifted by a short piece of masking tape and attached to the 3-inch end, and immediately dropped into a Faraday pail. Each specimen was charged and measured at least four time. The largest value measured for the two specimens measured was 0.25 nanocoulombs/sq. cm. for one and 0.19 nanocoulombs/sq. cm. for the second specimen. The measurements were made at a relative humidity of 48% and at a temperature of 23 degrees C. A value of more than 0.45 nanocoulombs/sq. cm. is considered to be unsatisfactory, i.e. the possibility of spark discharge is high.

I claim:

1. A bulk container having flexible walls of (a) interwoven yarns of axially oriented, crystalline polypropylene and 1% to 18% by weight of the walls of an interlaced carrier yarn comprising fibers selected from the group consisting of polyester and nylon fibers said carrier yarn containing between 5 and 25% by weight sheath-core filaments having a nonconductive sheath of polyester or nylon and an electrically conductive core selected from the group consisting of polyolefin, polyester, or nylon and said core containing electrically conductive carbon black or graphite and (b) a coating of a thermoplastic polymer adhered to the inner surface of the flexible walls, said flexible walls being capable of dissipating an electrical charge.

2. The bulk container of claim 1 in which the core of sheath-core filaments is polyethylene containing 0.03 to 35% by weight conductive carbon black.

3. The bulk container of claim 2 in which core of the sheath-core filaments has from three to six lobes and a modification ratio of at least 2, with each lobe having an L/D ratio of 1 to 20, where L is the length of a line drawn from the center point of the line between low points of adjacent valleys on either side of the lobe to the farthest point on said lobe, and D is the greatest width of the lobe as measured perpendicular to L.

4. The bulk container of claim 3 in which the carrier yarn has a denier of between 800 and 3000.

5. The bulk container of claim 3 in which the carrier yarn comprises between 1% and 18% by weight of the walls.

6. The bulk container of claim 4 in which the thermoplastic coating is polypropylene and the coating comprises between 5 and 20% by weight of the walls.

7. The bulk container of claim 4 in which the carrier yarn is distributed at evenly spaced intervals in the walls of the carrier, at spacings of between ¼ and 2 inches.

8. The bulk container of claim 6 in which the yarns of axially oriented polypropylene are composed of a tight weave of axially oriented polypropylene flat tape.

9. The bulk container of claim 4 in which the carrier yarn runs in either the warp direction or the weft direction, but not both.

* * * * *